US005396995A

United States Patent [19]

Turek

[11] Patent Number: 5,396,995

[45] Date of Patent: Mar. 14, 1995

[54] HANGING FILE FRAME

[75] Inventor: Stanley P. Turek, Chicago, Ill.

[73] Assignee: Archer Manufacturing Corporation, Chicago, Ill.

[21] Appl. No.: 953,067

[22] Filed: Sep. 29, 1992

[51] Int. Cl.[6] ..... A47F 7/00

[52] U.S. Cl. ..... 211/46; 211/189; 312/184

[58] Field of Search ..... 211/46, 189; 312/184

[56] References Cited

U.S. PATENT DOCUMENTS

| | | | |
|---|---|---|---|
| 3,098,488 | 7/1963 | Schnelle | 211/46 X |
| 3,860,119 | 1/1975 | Irvine et al. | 211/189 X |
| 3,999,663 | 12/1976 | Walter et al. | 211/46 X |
| 4,030,610 | 6/1977 | Alexander | 211/189 X |
| 4,049,127 | 9/1977 | Alexander | 211/189 |
| 4,091,933 | 5/1978 | Alexander | 211/46 X |
| 5,205,626 | 4/1993 | Fotioo | 211/46 X |

*Primary Examiner*—Alvin C. Chin-Shue

*Assistant Examiner*—Sarah Purol

*Attorney, Agent, or Firm*—Dvorak and Traub

[57] ABSTRACT

A hanging file frame is provided for holding and supporting a plurality of hanging file folders. The hanging file frame includes longitudinal beams which are supported by an upper beam clasping element and a lower support element. Connectors secure the upper beam clasping element to the lower support element. The upper beam clasping element opens to accept the longitudinal beams. In one embodiment, upon closure of the clasping elements, the longitudinal beams are pressed against the nibs, thereby securing the beams to the clasping elements. In another embodiment, the longitudinal beams are pressed against raised strips, thereby securing the beams to the clasping element. In another variation, a frame member is comprised of a pair of U-shaped members, each having a gripping section, and having horizontally extending legs coupled together by a positionally adjustable sleeve slidably movable along the legs.

19 Claims, 3 Drawing Sheets

FIG. 1
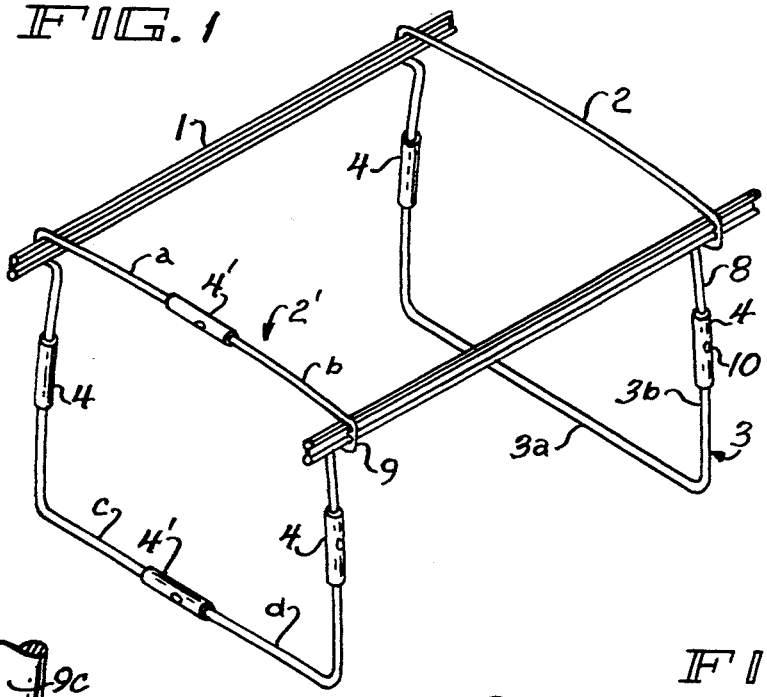
FIG. 7
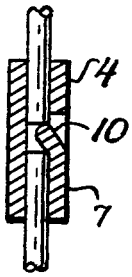
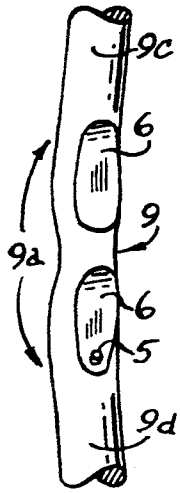
FIG. 2
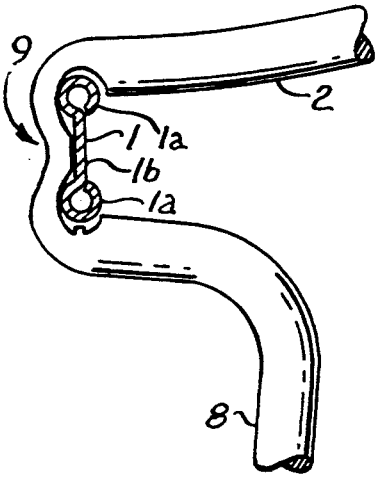
FIG. 3
FIG. 4
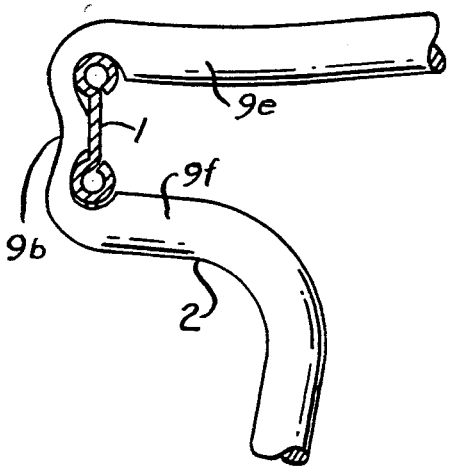
FIG. 5
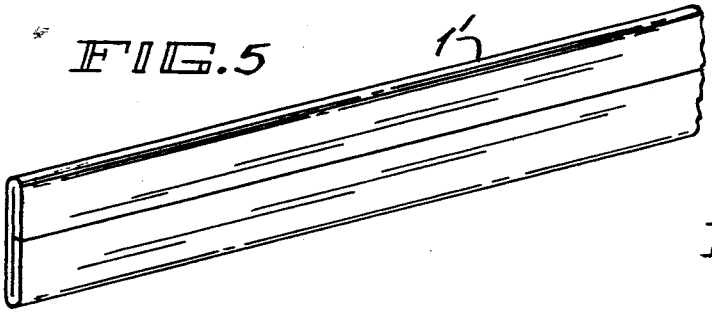
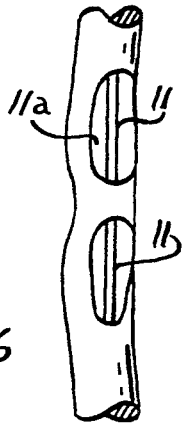
FIG. 6

FIG. 8
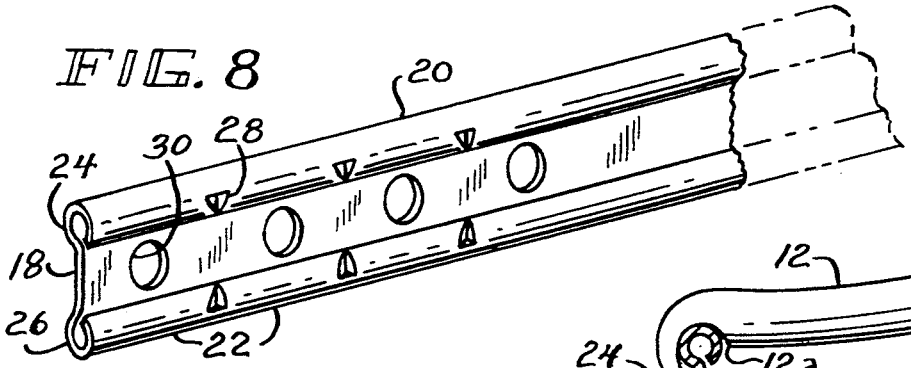
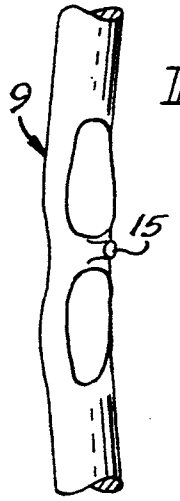
FIG. 9
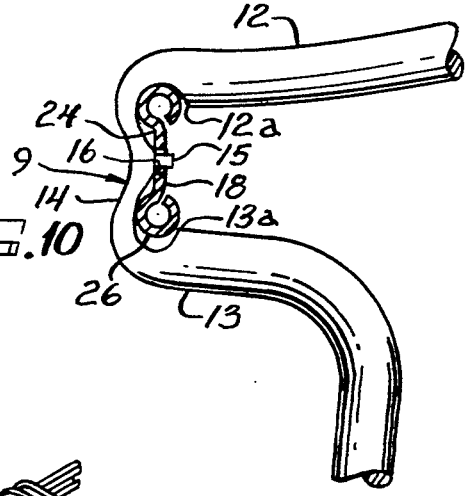
FIG. 10
FIG. 11
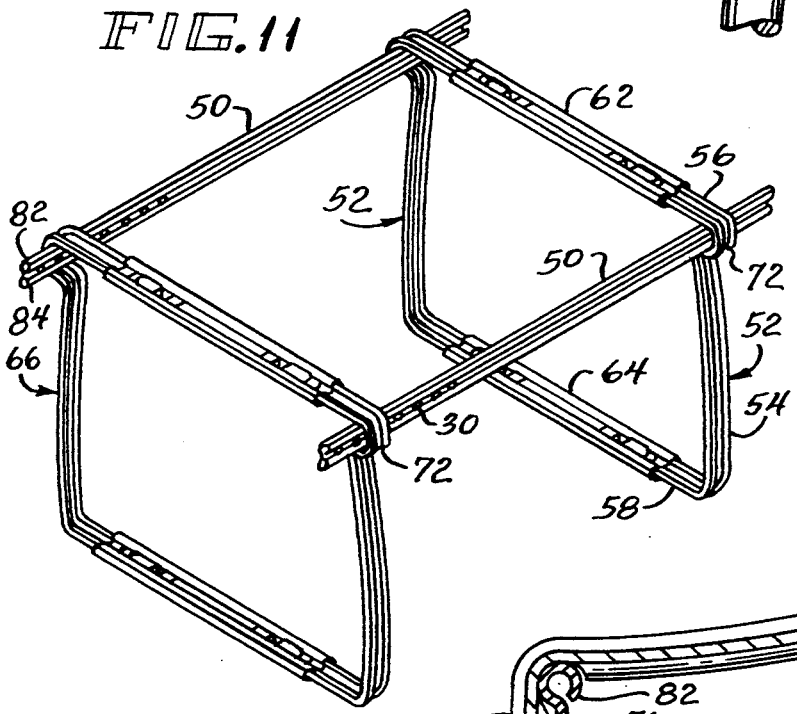
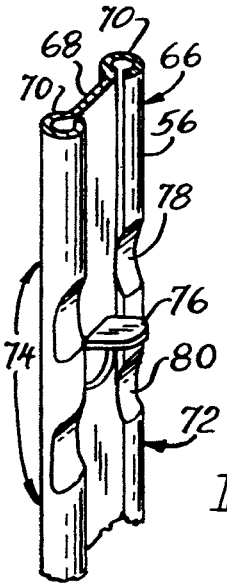
FIG. 12
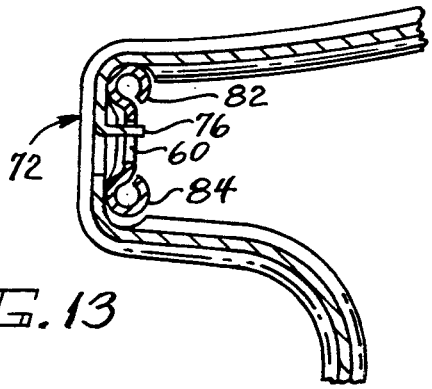
FIG. 13

FIG. 14
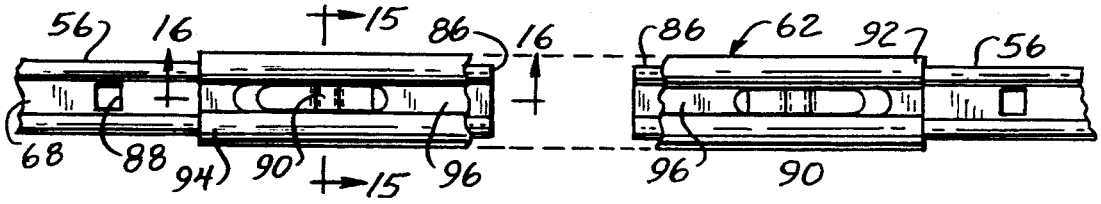
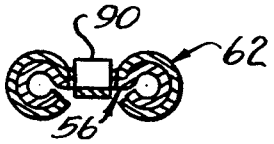
FIG. 15
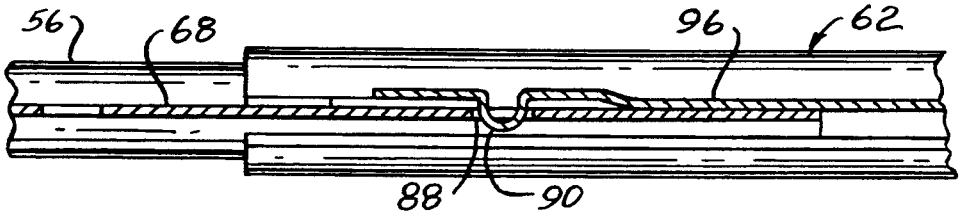
FIG. 16
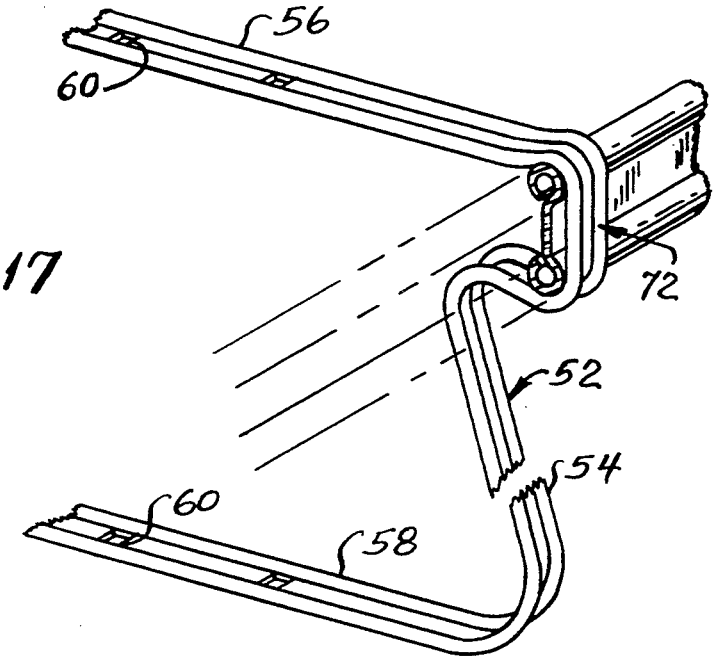
FIG. 17

HANGING FILE FRAME

BACKGROUND OF THE INVENTION

1. Field of the Invention

This invention is generally concerned with a framework for a suspension file, and particularly with a framework that can be adjusted along its length at any desired incremental position.

2. Description of the Prior Art

Hanging file frame arrangements have long been known for the purpose of maintaining files in a vertical configuration. Some of the well-known hanging file frame arrangements have been described in U.S. Pat. Nos. 3,295,697; 3,356,228; 3,651,949; 3,999,663; and 4,526,277. The known hanging file frames typically comprise horizontal supports for accepting ears disposed at the upper corners of a vertical hanging file folder, and generally vertical supports for maintaining the horizontal supports in a horizontal position, the horizontal supports being parallel to one another. Multi-element joining means are usually provided for securing the horizontal supports to the vertical supports.

It is known to have the multi-element joining means comprise a lower member which extends horizontally a short distance and which has a vertical threaded aperture which accepts a screw-type fastener, an upper member which has a horizontal section matching the horizontal section of the lower member and a vertical threaded aperture which aligns with the vertical aperture of the lower member. The screw-type fastener passes through the upper and the lower members, and must be tightened to draw the upper member towards the lower member, thereby gripping the horizontal supports.

However, problems have been encountered with the manufacturing and use of the aforesaid known hanging file frames. The manufacturing steps are relative complex and expensive, due to the necessity of forming threads on the apertures which receive the screw-type fasteners. The task of assembly in the field is clumsy at best. If assembled by a single person, the individual must simultaneously hold the lower member, position the upper member, insert the horizontal section, align the apertures to accept the screw-type fastener, screw in the fastener, and then tighten the fastener in order to secure the horizontal section to the upper and lower members. It is necessary to repeat this series of steps for each of the four corners of the hanging file frame.

SUMMARY OF THE INVENTION

The present invention overcomes the foregoing problems and others long associated with hanging file frames by utilizing a deformable upper base clasping element. The clasping element is deformably opened to accept a longitudinal beam, and then is deformably closed to secure the beam in place.

In the present invention, a plurality of lower support elements, which may be made of steel, aluminum, or other metallic wire, or a plastic material, are arranged such that each support element has a horizontal section which terminates in a vertical section at each end. The horizontal sections rest on a table, drawer bottom, or relatively flat surface. The vertical sections extend substantially at right angles with respect to the flat surface.

Female-female connectors are provided at the terminus of each vertical section. In one embodiment, the connectors are substantially hollow cylinders having a depressed central section which acts as a stop for the vertical sections.

Two longitudinal support beams are provided which are positioned to receive the generally hook-shaped ends of standard hanging file folders. The beams are an integral structural element of the present invention, providing a rigid interconnection between adjacent vertically arranged lower support/upper beam clasping elements. In one embodiment, the beam is an I-beam configuration wherein the longitudinal edges have a thickness greater than the web of the central section of the beam. In another embodiment, the beam is substantially flat, and uniform in thickness, being made from heavy-gauge material. In a further embodiment, the beam has rolled edges defining the end portions of a web. Further modifications of the beam includes spaced notches along the rolled edges to permit breaking off an unwanted length of the beam to achieve a proper length.

Beam clasping elements, which may be made of steel, aluminum, or other metallic wire, are arranged such that each clasping element has a central horizontal section, and vertical sections disposed at distal ends. Adjacent each distal end is a gripping section comprising a top horizontal section, contiguous with said central horizontal section, and which curves downward to meet the vertical section, and a lower horizontal section which curves downward to join the vertical section. Relieved beam accommodator sections are provided at the top and bottom regions of the central horizontal section. The free ends of each clasping element are coupled by connectors to free ends essentially "U" shaped and having a horizontal section terminating in vertical sections.

Also, a raised tab or strip may be provided in one or more of the beam accommodator sections. Upon securing the longitudinal beam in the clasping element, the beam is forced down into the tab or strip, compressing it into conformance with the shape of the beam contact surface, thereby ensuring a tight fit. In one embodiment, the upper beam clasping elements are formed from a substantially straight length of rod or wire, with relieved sections and a raised tab or strip being stamped or otherwise formed into the surface. A series of three bends are formed in opposite sides of the rod or wire, to provide gripping sections for a beam.

A hanging file frame has two substantially parallel longitudinal beams which are supported by a plurality of upper beam clasping elements connectable by connectors to lower support elements. Gripping sections are disposed at distal ends of the upper beam clasping elements and arranged and constructed to secure the longitudinal beams against the upper beam clasping elements, whereby the gripping sections are spreadable to accommodate the longitudinal beams and are closable to secure the beams in position.

Gripping sections are disposed at distal ends of the beam glasping elements, each gripping section having a U-shaped configuration for securing the beam in a predetermined position, a bight of the U-shaped gripping section having a reduced cross-section to facilitate the bending of legs from open to gripping position, the bight and the legs defining therebetween arcuate depressions for accommodating edges of an inserted beam, and means associated with the bight and the arcuate depressions for imparting a locking force on the beam when the two legs of the gripping section are forced towards each other to grip the edges of the beam.

A beam for use in a hanging file frame wherein the beam clasping element has a U-shaped configuration having a pair of downwardly extending legs adapted to be connected by connectors to a similarly configured lower support element having a pair of upwardly extending legs, the beam clasping element having a bight portion defining a pair of gripping sections at a junction with the downwardly extending legs, each gripping section has generally a U-shape configuration having a pair of generally horizontally extending shaped legs joined by a vertically extending bight>the junctions of the spaced legs with the vertically extending bight defining accommodators in the form of arcuate depressions for admitting edges of a longitudinal beam passing therethrough, the vertically extending bight having a reduced cross-section to facilitate the bending of the spaced legs with respect to an axis passing through the middle of the vertically extending bight between the two spaced legs.

The beam clasping element may be a U-shaped member having vertically-extending legs coupled by connectors to a lower support element having also a U-shape configuration. In a variation, the beam clasping element may comprise two angular parts having transverse, horizontally-extending portions coupled together by a connector, and the lower support element also comprising a pair of angular, horizontally-extending portions coupled together by a connector, the vertically-extending portion of the beam clasping element being coupled to vertically-extending portions of the lower support element by means of connectors.

In a further embodiment, the hanging file frame has a pair of substantially parallel-spaced longitudinal beams which are supported by a pair of spaced frame members, each frame member having at least two elements, and means are provided for coupling the elements together, the coupling means establishing a predetermined width for accommodation in a file cabinet, the elements having integrally formed gripping portions for compressively gripping the beams to establish a desired predetermined length of the file frame. Each element is made from an elongated metal strip having a web provided with a pair of rolled edges, and the coupling means is made from a wider metal strip of metal having a web provided with a pair of rolled edges, the wider metal strip slidably enclading said elongated strip, and engageable members between said both strips for locking together said strips.

The elongated strip is provided with a plurality of spaced apertures in the respective web, and the wider metal strip is provided with a tab extending out of its respective web and adapted to engage with one of the apertures to prevent relative movement between the strips.

The pair of substantially parallel-spaced longitudinal beams are provided at one end with a plurality of spaced apertures.

Each gripping section has a U-shape configuration, wherein a bight has a pair of standing arms, the rolled edges on the interior of the arms are provided with depressions which are adapted to embrace the rolled edges of the longitudinal beams, the bight having a punched-out tab extending between the arms and adapted to engage a selected aperture in the longitudinal beam to determine the desired length of the spacing between the frame members.

The steps required to produce this structure are much simpler, and less costly, than those required to produce the known hanging file frames.

The hanging file frame of the present invention is simple to assemble and adjust, and is readily adaptable to various sizes and shapes.

BRIEF DESCRIPTION OF THE DRAWINGS

The advantages and further aspects of the present invention will be readily appreciated by those having ordinary skill in the art by reference to the following detailed description in connection with the accompanying drawings in which:

FIG. 1 is a perspective view of the present invention utilizing longitudinal beams having rolled edges.

FIG. 2 is a detail view of a gripping portion on a clasping element on a rod.

FIG. 3 is a detail view illustrating the gripping portion on the clasping element in an open position, and a cross-sectional view of a first embodiment of a longitudinal beam.

FIG. 4 is a detail view illustrating the clasping element in a closed position, and a cross-section of the first embodiment of the longitudinal beam.

FIG. 5 is a perspective view of a section of a second embodiment of the longitudinal beam having overlapped edges.

FIG. 6 is a detail view of the clasping element having raised strips.

FIG. 7 is a detail view of a connector.

FIG. 8 shows a perspective view of a third embodiment of a longitudinal beam having notched edges and centrally located locking holes.

FIG. 9 is a detail view of another embodiment of a gripping portion on a clasping element having a locking nib.

FIG. 10 is a detail view illustrating the another embodiment of the gripping portion on the clasping element having the locking nib in an open position.

FIG. 11 is a perspective view of another embodiment of the present invention, similar to that shown in FIG. 1.

FIG. 12 is a detail view of another embodiment of a gripping portion on a clasping element having a locking tab, similar to FIG. 9.

FIG. 13 is a detail view illustrating the gripping portion in an open position, and a cross-sectional view of a further embodiment of the longitudinal beam, similar to FIG. 3.

FIG. 14 illustrates a connector for coupling ends of beam clasping elements.

FIG. 15 is a cross-sectional view taken along Lines 15—15 of FIG. 14 illustrating locked engagement of the connector with the end of the beam clasping element.

FIG. 16 is an enlarged partial cross-sectional view taken along Lines 16—16 of FIG. 14 illustrating locked engagement of the connector with the end of the beam clasping element.

FIG. 17 is a perspective view of another embodiment of a beam clasping element.

DETAILED DESCRIPTION

Referring now to the drawings in which like reference characters refer to like or corresponding parts throughout the several views, there is shown in FIG. 1 a hanging file frame embodying the present invention. A longitudinal beam 1 is shown extending through and secured by a beam clasping element 2. The beam 1 is formed from a flat strip of metal which has its opposed longitudinal edges rolled over to form spaced beads 1*a* extending from a web 1*b*. The beam clasping element 2 includes an integrally formed gripping section 9, disposed at each end. Each gripping section 9 leads to a downwardly projecting vertical section 8. Female-female connectors 4 receive each of the vertical sections 8. A lower support element 3 is U-shaped and comprises a substantially horizontal central section 3*a* and an upwardly projecting vertical section 3*b* at each end. The connectors 4 mechanically couple the upwardly projecting vertical section 3*b* of support element 3 with the downwardly projecting vertical sections 8.

As shown in FIG. 1, the beam clasping element 2 and the lower support element 3, each comprise a single member. To facilitate the shipment of the hardward comprising the hanging file frame, the beam clasping element 2' may comprise two separate members a and b coupled together by a coupling 4', and the lower support element may comprise two separate parts c and d coupled together by a connector 4'.

A stop 10 is disposed at approximately a midpoint of each connector 4. In one embodiment, as shown in FIG. 7, the connectors 4 are substantially hollow tubes, and the stop 10 is an indentation of a sidewall of the connector.

Referring to FIG. 2, a detail view of the gripping section 9 is shown. At this stage, the rod or wire which comprises the gripping section 9 has not yet been bent into its final shape. Beam accommodators 6 are formed in a central region 9*a* of the gripping section 9. The gripping section 9 has portions 9*c* and 9*d* which will define arms 9*e* and 9*f*, respectively, when the gripping section 9 is deformed into a U-shape about the beam 1, as shown in FIGS. 3 and 4. A midpoint 9*b* of the central region 9*a* has a reduced cross-section to facilitate the bending of the gripping section 9. A raised nib 5 is provided in at least one of the beam accommodators 6. The raised nib 5 forms a dimple in the bead 1*a* in response to a force exerted by the contacting surface of the beam 1 as the gripping section 9 is moved from an open position to a gripping position.

Referring to FIG. 3, a detail view of the gripping section 6 in the open position is shown. At the time the beam clasping element 2 is formed, its gripping section 9 is in the open position as shown in FIG. 3.

To open the gripping section 9, and to allow the longitudinal beam 1 to pass through the gripping section 9, the beam clasping element 2 is pulled out of its engaging connectors 4. Then, the vertical sections 8 are grasped by hands and pulled apart slightly to open the gripping sections 9 to release the beams 1.

To close the gripping section 9, and to secure the longitudinal beam 1 to the beam clasping element 2, it is necessary to bend the free ends of the vertical sections 8 of the clasping element 2 towards each other. This forces the beam accommodators 6 against the beam 1, ensuring a tight compression fit.

Referring to FIG. 5, a perspective view of another embodiment of a longitudinal beam 1' is shown. For strength, it is preferably formed by folding a metal strip or ribbon. On the other hand, this embodiment may be made from a heavier gauge metal strip.

Referring to FIG. 6, a detail view of the gripping section 9 is shown wherein each accommodator 6 is provided with a strip 11 which rises a short distance out of a face 11*a* of the accommodator 6. The raised strips 11 formed in the accommodators 6 are adapted to dig into the spaced beads 1*a* of the beam 1 or opposed edges 1*b* of the beam 1'.

Referring to FIG. 7, a detail view of the tubular connector 4 is shown. The stop 10 serves the purpose of limiting the penetration by the free ends of the vertical sections 8 of the beam clasping elements 2 and the free ends of the vertical sections 3*b* of the lower support element 3.

As shown in FIGS. 9 and 10, the gripping portion 9 has a general "U" shape, having two substantially horizontal portions 12 and 13 which are spaced apart and joined by a bight portion 14 which at its mid-portion is provided with a nib 15 extending inwardly between the horizontal portions 12 and 13. The nib 15 extends through a hole 16 in a web 18 of a further embodiment of a longitudinal beam 20 as shown in FIG. 8. The beam 20 has at least one end provided with frangible sections 22. The web 18 interconnects a pair of spaced rounded beads 24 and 26, each rounded bead being provided with spaced notches 28. Each frangible section 22 is provided with a centrally located aperture 30, which functions to receive the nib 15 extending out of the bight 14. The longitudinal beam 20 is essentially the same as shown in the sectional views of FIGS. 3 and 4 except for the modification of containing the frangible sections 22 which enable the longitudinal beam to be readily broken to accommodate a particular depth of a filing cabinet.

As noted in FIG. 10, the nib 15 is integrally formed with the bight portion 14 which has a reduced thickness to facilitate the bending of the horizontal portions 12 and 13 for the purpose of interlocking the nib 15 with the hole 16. At the same time, the central portion of the bight 14 exerts an abutting force against the web 18 of the beam 20 as arcuate portions 12*a* and 13*a* of the horizontal portions 12 and 13, respectively, enclasp the beads 24 and 26.

In the event that it is necessary to reposition the beam clasping element 2 with respect to the position on the longitudinal beam 20, the clasping element 2 is pulled upwardly to remove it from the connectors 4, thereby permitting the vertical sections 8 to be pulled apart from each other so as to enlarge the opening between the horizontal portions 12 and 13.

Whereas the embodiment shown in FIG. 1 uses a pair of longitudinal beams 1 coupled by beam clasping elements 2 made from rods, the embodiment shown in FIG. 11 uses exclusively members made from flat stock having rolled edges. Longitudinal beams 50 have identical construction to the beam 20 illustrated in FIG. 8. The longitudinal beams 50 are coupled to two pairs of beam clasping elements 52, each having a vertical portion 54 terminating in upper and lower transverse portions 56, 58, respectively. The configuration of a single beam clasping element 52 is best illustrated in FIG. 17, wherein the upper and lower transverse portions 56, 58, respectively, are provided with a plurality of apertures 60. Each pair of the beam clasping elements 52 is coupled together by a pair of upper and lower connectors 62 and 64. The longitudinal beam 50 comprises a strip of metal 66 having a web 68 extending between a pair of spaced rolled edges 70. Each beam clasping element 52 has a gripping section 72. The gripping section 72, in its unformed shape, is illustrated in FIG. 12, wherein in the central portion 74, a tab 76 is punched out of the web 68, and the rolled edges 70 are deformed to possess depressions 78 and 80 which are adapted to embrace edges 82, 84 of the longitudinal beam 50, and the tab 76 will engage with one of the apertures 60 in the longitudinal beam 50 after the gripping section 72 clasps the longitudinal beam 50 as shown in FIG. 11, and a semi-closed position shown in FIG. 13.

As shown in FIG. 14, ends 86 of a pair of upper transverse portions 56 are coupled together by a connector 62, the upper transverse portions 56 being provided with a plurality of apertures 88 which are adapted to be engaged by a tab 90.

The connector 62 is made from a strip of metal having a pair of rolled edges spanned by a web 96. As shown in FIG. 14, the connector 62 is provided adjacent each end with a tab 90 punched out of the web 96, which tab 90, as shown in FIG. 15, is adapted to engage with one of the apertures 88 in the web 68 of the upper transverse portion 56. It is to be understood that the description discussing the upper transverse portion 56 applies equally to the lower transverse portion 58.

As best viewed in FIG. 15, the connector 62 is configured to substantially enclose the shape of the upper transverse portion 56 so that it can be moved slidably along the upper transverse portion 56 until engagement is reached between the tab 90 and one of the apertures 88 to determine a particular setting of the width in a filing cabinet drawer.

Although a particular embodiment of the present invention has been described in the foregoing detailed description, it will be understood that the present invention is not limited to the embodiments disclosed, but is capable of numerous modifications without departing from the spirit of the invention.

What is claimed is:

1. A hanging file frame comprising:

two substantially parallel horizontal beams, a plurality of lower support elements, each of said lower support elements having a first and a second end, a substantially vertical section at each end, and a substantially horizontal section therebetween, a connector for coupling at terminal points of each of said lower support elements, a plurality of upper beam clasping elements connectable by said connectors to said lower support elements, integrally formed gripping section at distal ends of said upper beam clasping elements, said gripping sections arranged and constructed to secure said longitudinal beams against said upper beam clasping elements, said gripping sections being provided with beam accommodators which have raised tabs for engaging with the surface of the engaged beam, whereby said gripping sections are spreadable to accommodate said longitudinal beams, and are closable to secure said beams in position.

2. A frame according to claim 1, further comprising raised strips disposed on said beam accommodators for engaging with the surface of the beam.

3. A frame according to claim 1, further comprising a stop disposed within said connector, said stop arranged and constructed to limit the insertion depth into said connector of said vertical section and said lower support elements.

4. A frame according to claim 3, wherein said connector is a substantially hollow tube.

5. A frame according to claim 1, wherein each of said gripping sections comprise at least three substantially right angle bends.

6. A frame according to claim 1, wherein each integrally formed gripping section comprises a pair of spaced substantially horizontal portions joined by a bight, a mid-portion of said bight having a reduced thickness and indented inward between said two longitudinal portions, and a nib integrally formed on said bight and extending inwardly to engage with a respective hole in the web.

7. A hanging file frame comprising:

a pair of longitudinal beams, a pair of U-shaped support elements, a pair of generally U-shaped beam clasping elements, connectors for coupling vertically extending portions of the support elements with corresponding vertically extending portions of the beam clasping elements, gripping sections disposed at distal ends of said beam clasping elements, each gripping section having a U-shaped configuration for securing the beams in predetermined position, the bight of the U-shaped gripping section having a reduced cross-section to facilitate the bending of legs from open to a gripping position, the bight and the legs defining therebetween arcuate depressions for accommodating edges of the beam, and locking means associated with the bight and the arcuate depressions for imparting a locking force on the beam when the two legs of the gripping section are forced toward each other to grip the edges of the beam.

8. The frame according to claim 7, wherein said locking means includes at least a protuberance in one of the depressions, whereby upon application of force to the legs of the U-shaped member, the protuberance will indent into an edge of the beam.

9. A frame according to claim 7, wherein the locking means comprises a locking nib extending outwardly from the bight between the two legs, and said beam having a plurality of locking holes extending medially across the width of the beam and longitudinally to define a number of locking spaces, whereby upon application of force on the legs to provide gripping of the beam, said locking nib will additionally secure the beam passing through one of said locking holes.

10. A beam clasping element for use in a hanging file frame wherein the beam clasping element has a generally U-shaped configuration having a pair of downwardly extending legs adapted to be connected by connectors to a similarly configured lower support element having a pair of upwardly extending legs, said beam clasping element having a bight portion defining a pair of gripping sections at a junction with said downwardly extending legs, each gripping section has generally a U-shaped configuration, having a pair of generally horizontally extending spaced legs joined by a vertically extending bight, the junctions of the spaced legs with the vertically extending bight defining accommodators in the form of arcuate depressions for admitting edges of a longitudinal beam passing therethrough, the vertically extending bight having a reduced cross-section to facilitate the bending of the spaced legs with respect to an axis passing through the middle of the vertically extending bight between the two spaced legs.

11. A beam clasping element according to claim 10, wherein a protuberance extends outwardly in one of the arcuate depressions and adapted to abut an edge of a beam inserted into the gripping section.

12. A beam clasping element according to claim 10, wherein a tab extends between said spaced legs out of the vertically extending bight and adapted to abut a median portion of a beam inserted into the gripping section.

13. A beam clasping element according to claim 10, wherein a locking nib extends between said spaced legs out of the vertically extending bight, whereby the locking nib is adapted to engage with a locking hole in a central portion of a beam inserted in the gripping section.

14. A hanging file frame comprising:

a pair of substantially parallel-shaped longitudinal beams, a pair of spaced frame members, each frame member comprising at least two elements, and means for coupling said elements together, said coupling means establishing a predetermined width for accommodation in a file cabinet, said elements having integrally formed gripping portions for compressively gripping said beams to establish a desired predetermined length of said file frame, each frame member comprises two "U"-shaped members, each having a bight and extending legs, coupled together by said coupling means to define an oblong configuration, said gripping portion has a "U"-shape configuration having a bight with spaced arms to enclasp side edges of said beam, the mid-portion of said bight has a reduced cross-section to facilitate the bending of arms extending out of said bight to firmly grip said beams, junctions of the bight end and the arms are provided with indentations providing arcuate surfaces conforming to the shape of the beam edges, and one of said junctions is provided with an integrally formed nib to deform an edge in the beam.

15. A frame according to claim 14, wherein said mid-portion of said bight is provided with a nib and an end portion of said beam is provided with spaced apertures adapted to be engaged by said nib for obtaining length adjustability.

16. A frame according to claim 14, wherein each element adjacent one end has a gripping upper portion terminating in a transversely extending leg, and a lower portion extending downwardly and terminating in an angled transversely extending lower leg, said coupling means being an elongated sleeve having a cavity for receiving said upper and lower legs, and position locking means defined between the sleeve and said legs for establishing proper spacing between the beams.

17. A frame according to claim 16, wherein said position locking means comprise tabs on said sleeves engageable with apertures in said legs.

18. A frame according to claim 14, wherein each element is made from an elongated metal strip having a web provided with a pair of rolled edges and said coupling means is made from a wider metal strip of metal having a web provided with a pair of rolled edges, said wider metal strip slidably enclading said elongated strip, and engageable members between said both strips for locking together said strips.

19. A frame according to claim 18, wherein said elongated strip is provided with a plurality of spaced apertures in the respective web and said wider metal strip is provided with a tab extending out of its respective web and adapted to engage with one of said apertures to prevent relative movement between said strips.

* * * * *